US005321191A

United States Patent [19]

Alagy et al.

[11] Patent Number: 5,321,191

[45] Date of Patent: * Jun. 14, 1994

[54] PROCESS FOR THE THERMAL PYROLYSIS OF HYDROCARBONS USING AN ELECTRIC FURNACE

[75] Inventors: Jacques Alagy, Charbonnieres; Paul Broutin, Ecully; Christian Busson, Charbonnieres; Jérôme Weill, Lyons, all of France

[73] Assignee: Institut Francais du Petrole, Rueil-Malmaison, France

[ * ] Notice: The portion of the term of this patent subsequent to Nov. 3, 2009 has been disclaimed.

[21] Appl. No.: 972,782

[22] Filed: Nov. 9, 1992

[30] Foreign Application Priority Data

Nov. 8, 1991 [FR] France ..... 91 13976

[51] Int. Cl.[5] ..... C07C 4/04

[52] U.S. Cl. ..... 585/648; 585/649; 585/650; 585/921; 585/926

[58] Field of Search ..... 585/648, 649, 650, 921, 585/926, 911, 914

[56] References Cited

U.S. PATENT DOCUMENTS 1,407,339 2/1922 Steenbergh ..... 196/107
5,160,501 11/1992 Alagy et al. ..... 585/500

FOREIGN PATENT DOCUMENTS 0323287 7/1989 European Pat. Off. .
0457643 11/1991 European Pat. Off. .
1305287 8/1962 France .

*Primary Examiner*—Anthony Mc Farlane
*Assistant Examiner*—P. Achutamurthy
*Attorney, Agent, or Firm*—Millen, White, Zelano & Branigan

[57] ABSTRACT

A process for the thermal pyrolysis of hydrocarbons in a reactor (1) of elongate shape comprising at a first end supply means (5) for a gaseous mixture containing at least one hydrocarbon, at the opposite end discharge means (10) for the effluents produced and between these two ends supply means (9) for effluent cooling fluid, the reactor comprising in a first part (first end side) a plurality of electric heating means (3) enclosed by casings (4) disposed in substantially mutually parallel layers perpendicular to the axis of the reactor, in such a way as to define between the casings and/or the casings and the walls (22), spaces or passages for circulation of the gaseous mixtures and/or effluents. The heating means heat the passages in successive, individual, transverse sections which are substantially perpendicular to the axis of the reactor. The reactor comprises means for introducing into the casings (4) a gas G known as a casing gas which preferably contains water vapour and/or hydrogen. The permeability of the casings is sufficient to permit diffusion, at least at certain points, of at least a part of the gas G from inside the casings to the outside of the casings, the gas G then being diluted in the gaseous mixture.

14 Claims, 3 Drawing Sheets

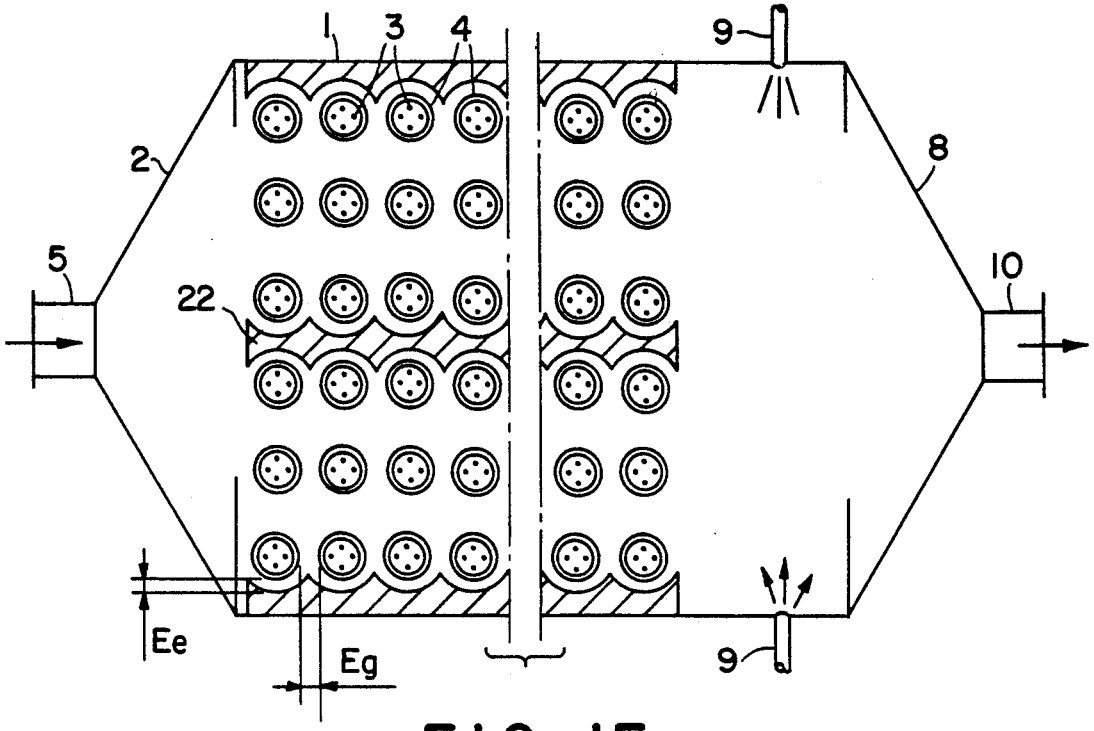
FIG. 1F
FIG. 2
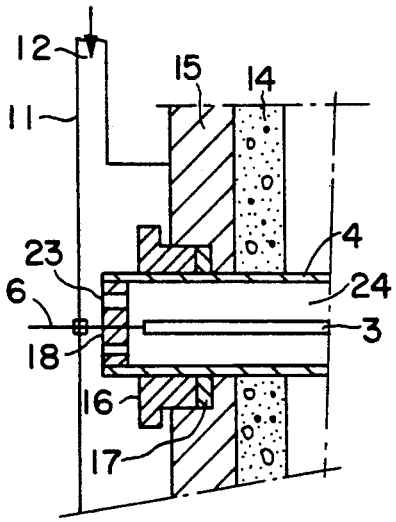

PROCESS FOR THE THERMAL PYROLYSIS OF HYDROCARBONS USING AN ELECTRIC FURNACE

BACKGROUND OF THE INVENTION

The invention relates to a process for the thermal pyrolysis of hydrocarbons using an electric furnace. This process is aimed, in particular, at the production of light olefins, and, more particularly, of ethylene and propylene.

A number of patents describe processes and reactors for the implementation of these processes. In particular, the assignee's patent U.S. Pat. No. 4,780,196 can be cited which describes a process for thermal pyrolysis in the presence of water vapour which is known as a steam-cracking process and is used in a multi-channel reactor made of a ceramics material. This process gives good yields of ethylene and propylene. However, the reactor is of a delicate design, the ceramics materials used to make it are relatively expensive, and it is difficult to maintain a constant temperature all along the reaction zone which has adverse effects on the process.

The prior art is illustrated, in particular, by the patents EP-A-323 287, EP-A-457 643, FR-A-1 305 287 and U.S. Pat. No. 1,407,339.

One of the major problems encountered with the implementation of thermal pyrolysis, and, in particular, with the steam-cracking of hydrocarbons is connected with the formation of coke. This formation is largely due to secondary reactions such as the formation of condensed polycyclic aromatic hydrocarbons and also to the polymerisation of the olefins formed. This latter reaction is a result of the tendency of the olefins to polymerise when the temperature is in the order of 500° C. to 600° C.; thus, in order to reduce the affects of this secondary reaction, rapid cooling (often called tempering) often has to be effected of the effluents of the reaction in order to bring them quickly from the temperature at which the pyrolysis operation was effected to a temperature which is less than about 500° C., usually by means of an indirect heat exchanger.

In order to increase the selectivity of the reaction to produce olefins, studies made on the thermodynamics and kinetics of pyrolysis reactions for hydrocarbons therefore involve the following parameters:

rapid increase of the temperature of the charge to the optimum pyrolysis temperature for a given charge, and keeping that temperature as constant as possible in the reaction zone, reduction to stay time of the charge in the reactional part, reduction of partial pressure of hydrocarbon charge, rapid and effective tempering of the effluents from the reaction.

It is therefore particularly important to reduce to a minimum the contact time between the products of the reaction and the hot walls of the reactor.

Technologically speaking, these conditions have quickly led to a general process outline consisting in:

a) preheating the charge which may be diluted by water vapour, b) heating that charge, or the mixture of charge and water vapour, at high temperature in tubular furnaces in order to restrict the stay time of the hydrocarbons during this pyrolysis stage, c) rapid tempering of the effluents from the reaction.

The development of thermal pyrolysis furnaces, and, in particular, of steam-cracking furnaces, has essentially been aimed at reducing the stay times and reducing the loss of charge. This has led the designers to reduce the length of the tubular reactors, and thus to increase the density of the thermal flux.

Increasing this latter can basically be done by increasing the wall temperature of the walls of the tubular reactors and/or by reducing the diameter of the tubes (which permits an increase in the s/v ratio, s being the exchange surface and v being the reactional volume).

The progress which has been made in metallurgy with special alloys which are resistant to increasingly high temperatures (INCOLOY 8OOH, HK 40, HP 40, for example) has made it possible for designers of pyrolysis furnaces, particularly those for steam-cracking, to increase the operating temperatures of these tubular furnaces, current limits in metallurgy being in the region of about 1300° C.

Moreover, technology has also made progress with regard to the use of tubes of smaller diameter which are placed in parallel in order to maintain a satisfactory capacity and to remain within a suitable range of charge loss.

Proposals have also been made for several designs of pyrolysis furnaces, all of them aiming to increase the density of thermal flux at the start of the pyrolysis tube and to consequently reduce it either by using tubular reactors of increased diameter, or by grouping together at least two pyrolysis tubes to form one single one after a certain length of reaction zone (see, for example, the article by F. WALL et al published in Chemical Engineering Progress, December 1983, pages 50 to 55); non-cylindrical tubular furnaces have also been described which aim to increase the s/v ratio; thus the patent U.S. Pat. No. 3572999 describes the use of tubes of oval section, and the patent U.S. Pat. No. 3964873 describes the use of tubes of dumb-bell-shaped section.

Techniques employing thermal pyrolysis reactors, and, in particular, steam-cracking reactors have advanced from the use of horizontal tubes of approximately 100 meters (m) in length and with internal diameters in the order of 90 to 140 millimeters (mm) to the conventional use of vertically suspended tubes, approximately 40 m in length, and with diameters in the order of 60 mm which operate with residence times in the order of 0.3 to 0.4 seconds (s), and finally, the technique known as the millisecond technique, as proposed by PULLMAN-KELLOG (patent U.S. Pat. No. 3,671,198) which employs vertical, rectilinear tubes which are approx. 10 m in length, and with an internal diameter of 25–35 mm, which are brought to temperatures in the order of 1100° C. (this temperature most frequently being closest to that of the limit of use of metal). The residence time of charges in this kind of furnace is in the order of 0.07 s; the loss of charge observed is in the order of 0.9 to 1.8 bar (1 bar is equal to 0.1 megapascal), and calculation of the ratio of the exchange surface s to the reactional volume v gives values in the order of 120 $m^{-1}$.

SUMMARY OF THE INVENTION

One of the objects of the invention is to overcome the afore-described drawbacks. The objectives which it is proposed to meet, which satisfy the problems arising with the prior art are basically as follows:

to restrict the formation of coke to a maximum, particularly on hot surfaces such as the walls of the casings enclosing the resistances, for example, to use as the gas in the space for the resistances a gas or a mixture of gases preferably comprising a gas which is already present in the gas mixture circulating in the process space, thereby permitting the use of casings which do not have to have very great sealing properties, to improve the heat exchange between the gaseous mixture containing at least one hydrocarbon which comprises at least two carbon atoms or a mixture of hydrocarbons containing at least two hydrocarbons, one, at least, of which is a hydrocarbon which has at least two carbon atoms, and the hot surfaces in contact with the mixture, to increase reliability of the device, to increase ethylene and propylene yields compared with existing processes.

The present invention proposes a process and a device for its implementation which offers considerable improvements over prior art embodiments, such as simpler, more flexible, better controlled and cheaper implementation both as far as expense and profit are concerned, for example. The flexibility of use is connected with the use of electricity which allows the thermal flow and thus the temperature profile of the gas process to be controlled as desired.

More particularly, the invention relates to a process for the thermal pyrolysis of hydrocarbons in a reaction zone of elongate shape in one direction (one axis), comprising a heating zone and a cooling zone following on from said heating zone, wherein a gaseous mixture containing at least one hydrocarbon with at least two carbon atoms is circulated in the heating zone in a flow direction substantially parallel to the direction (axis) of the reaction zone, said heating zone comprising a plurality of electric heating means arranged in layers substantially parallel to each other and forming a transversely projecting bundle of triangular, square or rectangular pitch, said heating means being grouped in successive transverse sections which are substantially perpendicular to the direction (axis) of the reaction zone, which are independent of each other and which are supplied with electric energy in such a way as to define at least two parts in the heating zone, the first part enabling the charge to be brought to a temperature which is at least equal to about 1300° C., and the second part which follows on from the first part enabling the charge to be kept at a temperature which is substantially equal to the maximum temperature to which it was brought in the first part, and wherein the effluents from the heating zone are cooled, and the products formed at the end of the reaction zone are collected, said process being characterised in that the electric heating means are insulated from direct contact with the gaseous mixture containing at least one hydrocarbon by casing in which a gas G, known as the casing gas or sealing gas, is introduced, the casings being of appropriate permeability and the gas being introduced inside said casings at a pressure such that diffusion takes place, at least at certain places, of at least one part of the gas G from inside the casings to the outside thereof, the gas G then being able to be diluted in said gaseous mixture.

With this process, two spaces are defined within the reactor:

firstly, the reaction space or process space outside the casings which protect the resistances, in which space the gaseous mixture containing at least one hydrocarbon with at least two carbon atoms circulates.

secondly, the space for the resistances formed by the region between the actual resistances and the insulating casings, in which region the gas G is introduced.

The gaseous mixture circulating in the reaction space can also contain up to 20% by volume of methane. This mixture preferably contains less than 10% by volume of methane.

The process for thermal pyrolysis according to the present invention is used, in particular, for thermal pyrolysis of ethane, or a mixture of hydrocarbons containing ethane, in the presence of hydrogen.

In the thermal pyrolysis process of the present invention, the gaseous mixture circulating in the reaction space can also contain water vapour. In this latter case, the thermal pyrolysis process is usually described as "steam-cracking". The remainder of the description of the process of the present invention is made in connection with this case.

The heating zone is heated by the supply of electric energy by heating means such as electric resistances, and the heat emitted by the Joule effect in the resistances is transmitted mainly by radiation to the casings disposed loosely around the resistances. These casings are usually made of a ceramics material or any refractory material which can withstand the required temperatures and the reducing and/or oxidising atmospheres of the medium, such as some new metal alloys, for example, belonging to the company KANTHAL SA such as KANTHAL AF or KANTHAL APM. The gaseous mixture which contains at least one hydrocarbon and which circulates in the heating zone substantially perpendicularly to the axis of the casings is heated mainly by convection and by radiation.

The steam-cracking of hydrocarbons having at least two carbon atoms is a greatly endothermic reaction which requires a very major thermal flux density at a high temperature in the order of 800° to 1300° C. The maximum application of heat must be in the zone where the endothermic cracking reactions and dehydrogenation reactions take place; moreover, in view of the reactivity of the products formed, such as ethylene and/or propylene, it is necessary to have a relatively short, controlled contact time followed by rapid tempering in such a way that a temperature profile of the "square" kind is obtained, and in such a way that too great a coke formation is prevented.

The heat exchanges are one of the key elements for this kind of very endothermic reaction where it is necessary to transfer quite major amounts of energy from the resistances to the gaseous mixture containing at least one hydrocarbon with at least two carbon atoms, hereinafter named the gas process. During the preliminary study made by the Applicant on thermal exchanges in a pyrolysis furnace designed according to the model used in the present invention, it was seen that the exchange of heat from the resistance to the casing was essentially a radiative exchange, but that there was only slight radiative exchange between the casing and the gas process. In fact, this latter is usually essentially composed of a mixture of hydrocarbons and water, and this mixture does not absorb very much of the radiation emitted by the casings. Therefore, in the case envisaged by the present invention, thermal transfer between the gas process and the casings is mainly transfer by convection. In such a case, the quality of the heat exchanges is directly linked to the available exchange surface and to the surface/volume ratio.

Thus, if the exchange surface is relatively low, in order to obtain a given gas process temperature which corresponds to a conversion rate which has been selected beforehand, it is necessary to increase the temperature of the casings in proportions which increase as the surface becomes smaller. This means that there is an increased risk of coke formation and also the need to increase the temperature of the resistances which causes more rapid ageing of the resistances, or even, if the conversion rate selected beforehand is very high, a very large amount of energy needing to be transferred, and a greatly increased risk of deterioration to the resistances.

The walls have a large part to play in the exchange of heat since they are capable of absorbing the radiation emitted by the casings. Consequently, the temperatures of the casings and of the walls, tend to balance one another. It is therefore possible to significantly increase the exchange surface, almost to double it, by modifying the design of the device in the following way:

whereas in the initial design the casings protecting the resistances and permitting the transfer or heat to the gas process were preferably disposed in a staggered arrangement, with a preferred embodiment of the present invention they are aligned which permits the formation of n rows or layers of m resistances in the longitudinal extent (for a total number of resistances of $n \times m$). At least one longitudinal zone is thus formed, and most frequently two longitudinal zones are formed, each zone comprising at least one, and often more, layers of heating elements, each zone being separated from the following one by a wall of a refractory material. Through radiation, the temperature of the walls increases and tends to attain the same value as that of the casings enclosing the resistances. The walls thus also play a part in the convection heating of the gas process. Thus, in this embodiment, since the exchange surface is significantly increased and it is possible to obtain the same temperature of the gas process with a relatively lower temperature of the casings and walls, which thus also reduces coke formation. In the present description, the term, "heating element" refers to the assembly composed of a protective casing and at least one resistance inside said casing.

In one particular embodiment of the invention, each zone comprises one single layer of heating elements.

With these two embodiments, the convective exchanges between the gas process and the walls are greatly increased, and they can also be improved by imposing considerable speeds upon the gas process and by creating zones of unevenness. The speed of the gas process can be increased, for example, by using walls whose shape promotes such speed increase and the appearance of zones of unevenness. FIG. 1C shows, non-limitatively, walls of a particular shape.

The walls are usually made of a refractory material. Any refractory material can be used to make the walls, and zirconium, silicon carbide, mullite and various refractory concretes can be cited as non-limitative examples.

Since it is quite unnecessary for sealing to be provided over the walls, since the gas composition is practically identical on either side of the walls, this embodiment only slightly increases the cost of the furnace. In fact, it is first of all not necessary to have walls of a particular thickness, nor is it necessary to have a particularly complex embodiment. Secondly, the overall sizes of the furnace are not greatly increased because the main bulk of the furnace is accounted for by the width of the casings. By way of example, the casings can be in the order of 150 mm in width for a wall thickness in the order of 50 mm, and this only slightly increases the overall width of the furnace in the order of 30%.

An extra advantage of this embodiment with walls is that it enables the furnace to be simpler in design, the vertical walls in addition to improving the transfer of heat by convection enabling the storage area of the furnace to be supported.

Moreover, it is preferable if each wall comprises at least one means which permits the pressures in the longitudinal zones disposed on either side of the wall to be balanced. A simple but efficient way of enabling the pressures to be balanced is the creation of zones with one or more perforations or porous zones.

According to one of the features of the invention, the electric resistances which supply the heat to the heating zone are supplied independently with electric energy, either in isolation or in transverse rows, or in small groups in such a way that heating sections are defined along the heating zone, making it possible to modulate the amount of energy supplied all along the zone.

The heating zone is usually composed of 2 to 20 heating sections, preferably of 5 to 12 sections. In the first part of this zone, the gaseous mixture containing at least one hydrocarbon which has been heated beforehand to about 600° C. is usually brought to a temperature which is at most equal to about 1300° C., and advantageously between 800° and 1100° C. (the start of the heating zone is disposed at the place where the charge is introduced).

The heating sections are modulated in the conventional way; the heating elements which correspond to the afore-mentioned sections are usually supplied by modulator assemblies with thyristors. Transducers may enable voltages to be adapted a priori, whereas the modulators permit final and continuous control of the injected power.

In order to permit regulation of the assembly, each heating section can be equipped with a pyrometric rod with thermocoupling adapted to the temperature level; these rods are disposed in the spaces where the charge circulates, and data is transmitted to the regulator which controls the modulator with thyristor.

The first part of the heating zone is usually in length between 5 and 50%, advantageously between 10 and 20%, of the total length of the heating zone.

The electric energy which is supplied to this first part of the heating zone is such that it generates a steep temperature gradient which permits a relatively high mean temperature of the charge over the entire heating zone, and this is favourable for selectivity of the light olefins.

In the second part of the heating zone, the electric energy supplied to the various heating sections of that zone is modulated in such a way that the temperature variation all along the zone is low, usually less than about 50° C. (+ or −25° C. relative to the recommended value) and advantageously less than about 20° C. (+ or −10° C. relative to the recommended value).

Moreover, the use of different transverse heating sections which are independent of one another makes it possible to supply the maximum amount of heat energy at the level of the second part of the heating zone at the place where the majority of the endothermic reactions take place and to keep a quasi constant temperature in the rest of the heating zone.

The heating zone is usually in length about 50 to about 90% of the total length of the reaction zone.

Under the heating conditions given hereinabove, in particular, a very strong heat flow is obtained at high temperature. This usually means that the material of which the resistances are made has to be specially selected. Since it must be resistant to the atmosphere in which the resistances are bathed under the operating temperature conditions, the material must be capable of supplying quite a large output per surface unit. By way of example, the material which can be used to make the resistances can be silicon carbide, boron nitride, silicon nitride and molybdenum bisilicide ($MoSi_2$). It is usually preferable to use molybdenum bisilicide resistances which have a number of advantages when used at high temperature:

they accept a large charge (power emitted per surface unit) which can be up to 20 $W/cm^2$, they can operate at very high temperatures, they are subject to slight ageing over the passage of time, they can easily withstand atmospheres which are reducing at high temperatures.

In the process of the invention, the heating zone is followed by a cooling zone (or tempering zone) in such a way that the temperature of the effluents in the heating zone very quickly decreases towards about 300° C., for example. The heating zones and tempering zones can be incorporated, or not, in one and the same chamber which will be referred to hereinafter as the reactor.

According to one embodiment, direct tempering is effected; the effluents from the reaction leave the heating zone and are very quickly cooled through direct contact with a cooling fluid injected into the effluents using at least one injection device, usually made of a ceramics material, and disposed on the periphery of the reactor. The cooling fluid used may be hydrocarbon oils or water.

The total effluents resulting from the mixture are then collected and separated.

According to a preferred embodiment, the effluents from the reaction coming from the heating zone are cooled through indirect contact with a cooling fluid, for example by circulating said fluid in sealed conduits inside the cooling zone.

By way of this process, all these features permit cracking of ethylene and propylene hydrocarbons with a high conversion rate and high selectivity in these products.

The hydrocarbon charges which can be used within the general scope of the present invention comprise saturated aliphatic hydrocarbons, such as ethane, mixtures of alkanes or petroleum cuts such as naphthas, atmospheric gazoles and gazoles under vacuum, these latter possibly being able to have a final distillation point in the order of 570° C. If applicable, the petroleum cuts may have been subjected to a pretreatment such as a hydrotreatment. These charges can also contain up to 90% by volume of hydrogen. These charges most frequently comprise at least one hydrocarbon with two carbon atoms in its molecule. Very often, charges are used, a major part (more than 50% by volume) of which have hydrocarbons with at least two carbon atoms in their molecule.

By an illustrative way, it is possible to use as a petroleum cut a GPL cut coming from crude oil distillation or a cut coming from naphta or gasoil steamcracking such as the C4 cuts.

Among these cuts, the following ones can be cracked thermally in order to obtain for example acetylene, methylacetylene and propadiene:

the C4 cut rich in n-butane and isobutane coming from the atmospheric distillation of crude oil, the total C4 cut coming from steamcracking, the 1-3 butadiene coming from the butadiene extractive distillation of the total C4 cut issuing from steamcracking.

the raffinate coming from the butadiene extractive distillation of the total C4 cut issuing from the steamcracking, this raffinate being rich in n-butenes and isobutene, a cut rich in isobutene.

Given the high degree of the reaction temperature (comprised advantageously between 900° and 1 200° C.) which is required for optimizing the yields in acetylenic hydrocarbons, the thermal cracking of these cuts is preferably made by using hydrogen as a diluant. Therefore, the sealing gas G which is introduced into the casings surrounding the resistances will preferably be substantially pure hydrogen. Given the use of such a sealing gas, the casings are realized in a material that is preferably non porous, the leak of the gas G towards the process gas results from the sealing on each casing which is intentionally made up imperfect.

The weight ratio of diluent water vapour to hydrocarbon charge varies depending on the charges to be treated. It can be about 0.2:1 to about 1.5:1, and usually the ratio used is in the order of 1:1 when gazole under vacuum is used, and it is in the order of 0.5:1 for steamcracking of naphtha. A part of the diluent water vapour can be introduced with the gas G. This fraction which is introduced with the gas G can then represent up to 100% of the amount of water needed for the steamcracking. Preferably, this fraction represents 0 to 50% of that amount.

The charges to be treated have a stay time in the reaction zone which is usually about 2 milliseconds to about 1 second, preferably about 30 to about 400 milliseconds.

The gas G which is introduced into the casings surrounding the resistances is usually a gas which has no hydrocarbon capable of undergoing a thermal conversion reaction leading to the formation of coke. The gas is also selected in such a way that it does not endanger the resistance used and does not cause accelerated ageing of these resistances. The gas can be water vapour alone, hydrogen alone, or a mixture of gas containing water vapour and hydrogen. The gas G can also be an inert gas such as nitrogen or a rare gas such as helium or argon. The gas G can also be a mixture of gases containing in addition to the water vapour and/or hydrogen an inert gas or a rare gas such as those cited hereinabove, for example.

It is usually preferable to use a gas G which contains water vapour and/or hydrogen, and most frequently a gas containing a proportion of water vapour and/or hydrogen which is greater than about 50% by volume. Most frequently, use of a gas G is recommended which contains water vapour.

The permeability of the casings must be sufficient to permit the diffusion, at least at certain places, of at least a part of the gas G introduced into the space for the resistances towards the process space. It would not come outside the scope of the invention if the permeability of the casings were such that it permitted diffusion of all the gaseous compounds contained in the gas G introduced into the space for the resistances towards the process space. This permeability can result from sealing being provided on each casing in a way which may be incomplete, and/or from the use of a material formed by casings with an open porosity which permits passage of at least a part of the gas G, that is to say, in other words, a permeable material. Most frequently, use of a permeable material is recommended.

Thus, in accordance with a preferred embodiment of the invention, the casings which insulate the electric heating means from direct contact with the gaseous mixture containing at least one hydrocarbon are made of a porous material, the porsoity of which is sufficient to permit diffusion, at least of a part of the gas G through said casings. The casings are thus preferably made of a porous material with an open porosity of at least about 1% and of 40% at the most by volume relative to the volume of the wall, and usually about 5% to about 30%.

Use of the gas G containing water vapour and/or hydrogen which diffuses at least partially towards the process space is advantageous in several respects. It does not complicate the separating operations downstream of the pyrolysis furnace since the water vapour is a compound present in the space process and the hydrogen can be a compound present in the process space both as a product of the cracking reaction and possibly also as a component of the charge.

Moreover, according to the present invention, since it is no longer desirable to try and obtain sealing which is as perfect as possible between the space process and the space for the resistances, the cost of manufacturing the furnace is reduced, with the thermomechanical stresses at the joins between the casings also being reduced, which makes the device more reliable as a whole.

With casings made of a ceramics material, it is well-known to those skilled in the art that several types of ceramics material exist, in particular silicon carbide, which depend on the quality of the powder of which it is composed, and also on very different fritting conditions. Without wanting to go into too much detail, it is however possible to note that one of the quality-related criteria is concerned with the lowest remaining porosity after fritting. It is well-known that if a part of the porosity is closed, that is to say that it has no effect on the overall sealing properties of the material, another not insignificant part, especially for the commonest silicon carbide is open porosity and that in particularly at high temperature there is diffusion of at least a part of the gas G (or of at least one of the components of the mixture of gases) through the material. It will therefore readily be appreciated that when the sealing gas is a gas such as water vapour and/or hydrogen it is not necessary to use casings of ceramics material, in particular of silicon carbide, which are as seal-tight as possible, that is to say of very high quality which are therefore very expensive.

The use of ceramics casings, particularly of silicon carbide, of average quality, and with an open porosity of at least about 1% by volume (for example, about 20% by volume) is thus not only possible but even desirable, and the production cost of the furnace is lowered thereby. Moreover, the very existence of this open porosity creates at the surface of the ceramics casing on the side of the process space a partial pressure of the gas G introduced into the space for the resistances which somewhat insulates the surface of the ceramics material of the gas process into the insulating space for the resistances, and without wanting to go into the theory, this explains the significant reduction in the formation of coke since this latter is usually mainly formed at the surface of the casings, and, contrary to the products formed, are present in a local atmosphere which is less favourable for the formation of coke.

The term, "open porosity" is used in the description of the present invention to denote the porosity constituted by the microcavities in the solid ceramics components in question, the adjective, "open" signifying that there is free passage, firstly between the majority of said microcavities, and secondly between said microcavities and the internal and external surfaces of the components under consideration; the idea of free passage must also be considered as a function of the nature of the medium and of the physical conditions of the ceramics material. By way of example, for small molecules such as hydrogen or helium, free passage is easy, particularly if there is a pressure difference between the two surfaces of the piece of ceramics material. In this case, the component is said to be permeable to hydrogen, for example, or not sealtight.

The term, "closed porosity" is used in the description of the present invention to denote porosity formed by microcavities which do not communicate with the surface of the component. In this case, closed porosity only causes an overall reduction to the density of the component.

The process according to the invention can be implemented in a device comprising a reactor (1) of elongate shape along one axis, preferably of square or rectangular cross-section, comprising at a first end means (5) for supplying a gaseous mixture including at least one hydrocarbon, at the opposite end means (10) for discharging the effluents produced, and between those two ends means for supplying cooling fluid, said reactor comprising in a first part (first end side) a plurality of electric heating means (3) enclosed by casings (4), said means which are substantially mutually parallel being disposed in layers which are substantially parallel and perpendicular to the axis of the reactor in such a way as to define between the casings and/or layers formed by the casings spaces or passages for the circulation of gaseous mixtures and/or effluents, said heating means and said casings heating successive transverse sections of passages, which are individual and substantially perpendicular to the axis of the reactor, said reactor further comprising control means and heat regulating means connected to said heating means, and comprising in a second part (8) (opposite end side) contiguous with the first part means (9) for cooling the effluents connected to said means for supplying cooling fluid, said device comprising means for introducing, at a suitable pressure, a gas G known as the casing gas or sealing gas, which preferably contains water vapour and/or hydrogen, inside the casings (4) and in that said casings have a permeability which is sufficient to permit diffusion, at least at some places, of at least a part of the gas G from the inside of said casings to the outside of said casings, the gas G then being diluted in said gaseous mixture.

The means for introducing the gas G at a suitable pressure are means which are known to those skilled in the art. They can also have control means and regulating means for the pressure inside and outside said casings.

Said cooling means are means which are capable of cooling the effluents leaving the heating zone through direct, or indirect, contact.

The casings which usually loosely enclose the resistances can be disposed in superposed relationship or in staggered manner, and they can form a transversely projecting bundle of triangular, square or rectangular pitch.

The total number of layers forming the heating means and the number of heating means in each casing and per layer are not critical factors in the process; they are clearly dependent on the size of the heating means and of the casings which enclose them, and of the walls, if they are present, which separate the layers. The heating elements can be identical to each other or different, both in terms of size and heat output. By way of example, a heating element can have from 1 to 5 resistances, most frequently from 1 to 3 resistances, inside the casing.

The number of heating elements determines the maximum electric output available for a given reactional volume and also has an influence on the stay time of the charge; it is chosen as a function of the flowrate of the admissible charge, in consideration of these parameters.

Within the scope of the present invention, it is possible to form the assembly of the heating zone reactor and tempering zone either in the form of a single unit or in the form of various elements of identical shape joined in juxtaposed manner and assembled together using any means such as flanges.

The electric heating means which can be used within the scope of the present invention are preferably heating resistances which are capable of being used up to temperatures in the order of 1500° C.; it is preferable to use molybdenum bisilicide resistances, such as pin resistances, for example.

The casings which enclose the resistances in such a way as to prevent direct contact between the gaseous mixtures of the charge and the resistances are preferably tubular in shape. These casings made of a refractory material are usually either ceramic or fritted metal. It is possible to use ceramics materials such as mullite, cordierite, silicon nitride, silicon carbide, silica or alumina; silicon carbide is preferably selected because it has good properties of thermal conductivity. If the layers are separated by walls, the material selected for these walls can be the same as that used for the casings, but it is often different, particularly in consideration of the manufacturing cost of the furnace.

The distance between the heating elements of the casings is dependent on the section of the heating element. In the case of heating elements, the maximum circle diameter of which encompassing them is equal to d, the casings used are usually tubular or cylindrical of diameter D of about $1.2\times d$ to about $8\times d$, and most frequently about $1.5\times d$ to about $4\times d$.

The heating elements are arranged in parallel layers substantially perpendicular to the direction of flow of the charge (gas process), preferably substantially in alignment in such a way that the distance which separates two adjacent casings is as small as possible, whilst taking into consideration the conditions of permissible charge loss; the distance between the casings of two adjacent layers or that between the casings of one layer and the nearest wall in the case where the layers are separated by walls is usually the same as that between two consecutive casings in a given layer. This distance is usually such that the passages formed between the casings or between the casings and the closest wall, in which passages the gaseous mixture containing the hydrocarbons circulates, is about 1 to about 100 mm in size, most frequently being about 5 to about 40 mm in size.

According to one embodiment, the free spaces or passages defined hereinabove which are intended for circulation of the gas process are at least partly occupied by fittings, usually ceramics fittings, which are preferably heat conductors. Thus, for a given type of reactor, it is possible to reduce the stay time of the charge in the reactor by rendering homogeneous the flow of gaseous mixture and by better distributing the dissipated heat. The fittings can be in various forms, and they may be in the form of rings, for example (Raschig, Lessing or Pall rings), saddle-shaped members (Berl saddle members), barrels, closed cylindrical tubes.

BRIEF DESCRIPTION OF THE DRAWINGS

The invention will be better understood by the description of some embodiments which is given purely as an illustration, and in no way a limitative manner. It will be given hereinafter with the aid of the accompanying drawings where similar members are denoted by the same reference numerals and letters.

FIGS. 1A, 1B, 1C and 1F are longitudinal sections through a reactor perpendicularly to the axis of the casings. In FIG. 1B, the reactor contains a fitting. In FIGS. 1C and 1F, the reactor has walls which separate one or more layers of casings containing the electric heating means.

FIG. 2 illustrates a detail of a heating zone in a plane which is identical to that in FIGS. 1D and 1E.

DETAILED DESCRIPTION

Figure 1A:
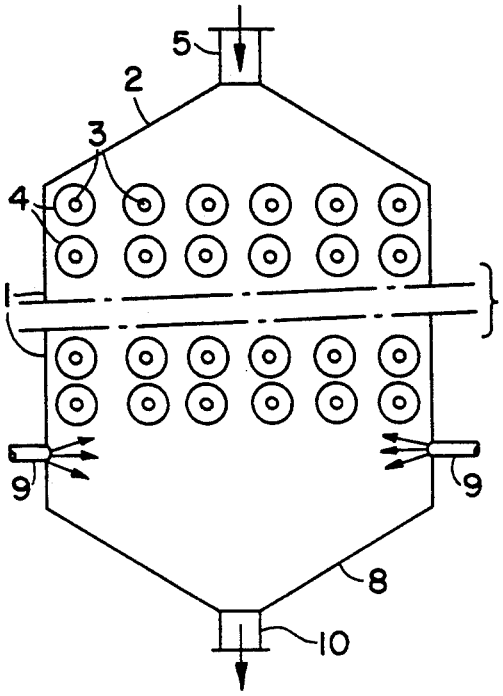

FIG. 1A shows, according to one embodiment, a vertical reactor (1) of elongate shape and rectangular section, comprising a distributor (2) which enables the reactor to be supplied through an intake orifice (5) with reactional gaseous mixture. This latter, which contains a mixture of water vapour and at least one hydrocarbon has been preheated in a conventional preheating zone, not shown in the drawings, preferably heated by convection. The reactor comprises a plurality of electric heating means (3) enclosed by casings (4) disposed in parallel layers and forming a bundle of square pitch in a plane (plane in the drawings). The layers define transverse heating sections which are substantially perpendicular to the axis of the reactor defined according to the direction of flow of the charge.

The heating sections are supplied by electric energy independently by virtue of a pair of electrodes (*6a*, *6b* in FIGS. 1D and 1E), and pyrometric probes with thermocouplings (7 in FIGS. 1D and 1E) are accommodated in the spaces where the charge flows between the casings (4), and they permit the temperature of each heating section to be regulated automatically by a conventional regulating device and modulating device not shown in the drawings.

In the first part of the heating zone, the casings are heated in such a way that the temperature of the charge passes rapidly from 600° C. (preheating temperature) to about 900° C.; this heating zone usually accounts for about 15% of the total length of the heating zone; the gaseous mixture then circulates in the second part of the heating zone where the temperature is usually kept constant, at a value which is substantially equal to that obtained at the end of the first heating zone, that is to say usually at about 900° C. To that end, the electric power supplied to a number of heating sections which form the second part of the heating zone is modulated; thus, a temperature variation is obtained which does not exceed about 10° C. from the recommened value. The length of the second heating zone accounts for about 85% of the total length of the heating zone.

At the exit from the heating zone, the effluents of the reaction are cooled in a cooling zone (8). They are placed in contact with a tempering agent such as water which is introduced by the intermediary of injection devices (9), tempering devices which are disposed at the periphery of the reactor (1) and connected to an external water source, not shown. The assembly of the gas effluents is cooled to a temperature of about 500° C. and collected by an exit orifice (10) at the end of the reactional zone (1).

According to another embodiment, not shown, the effluents can be cooled by circulating through sealed conduits disposed in the zone (8) through which the tempering agent flows, these conduits being connected to the external tempering agent source.

Figure 1B:
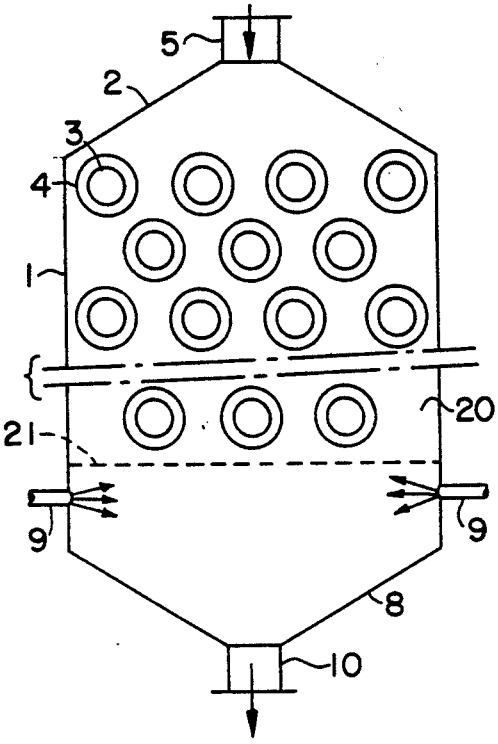

In the embodiment shown in FIG. 1B, the reactor which is identical to that shown in FIG. 1A comprises a fitting (20), advantageously made of ceramics material, in the space where the charge circulates, and this fitting is held by a grid (21) at the end of the heating zone. The casings (4) are disposed in parallel layers and form a bundle of triangular pitch (staggered arrangement) in a plane (plane in the drawings).

Figure 1C:
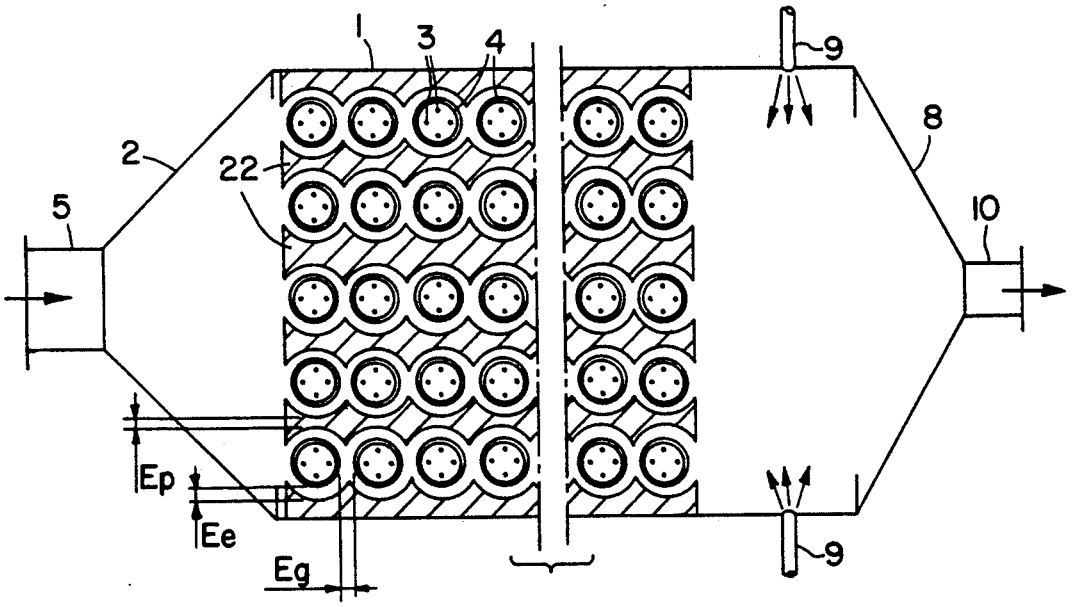

FIG. 1C shows, according to one embodiment, a horizontal elongate reactor (1) of rectangular section which only differs from the reactor shown in FIG. 1A by the fact that it is substantially horizontal, and by the fact that it comprises casings which are disposed in parallel layers forming a bundle of square pitch in a plane (plane in the drawings), and by the fact that the layers are separated from each other by walls (22) which are advantageously made of a ceramics material. The shape of the walls is such that regions of unevenness are formed in the form of cavities on each casing (4).

The embodiment shown in FIG. 1F only differs from that outlined in FIG. 1C in that a plurality of heating elements are disposed between two walls (22).

Figure 1D:
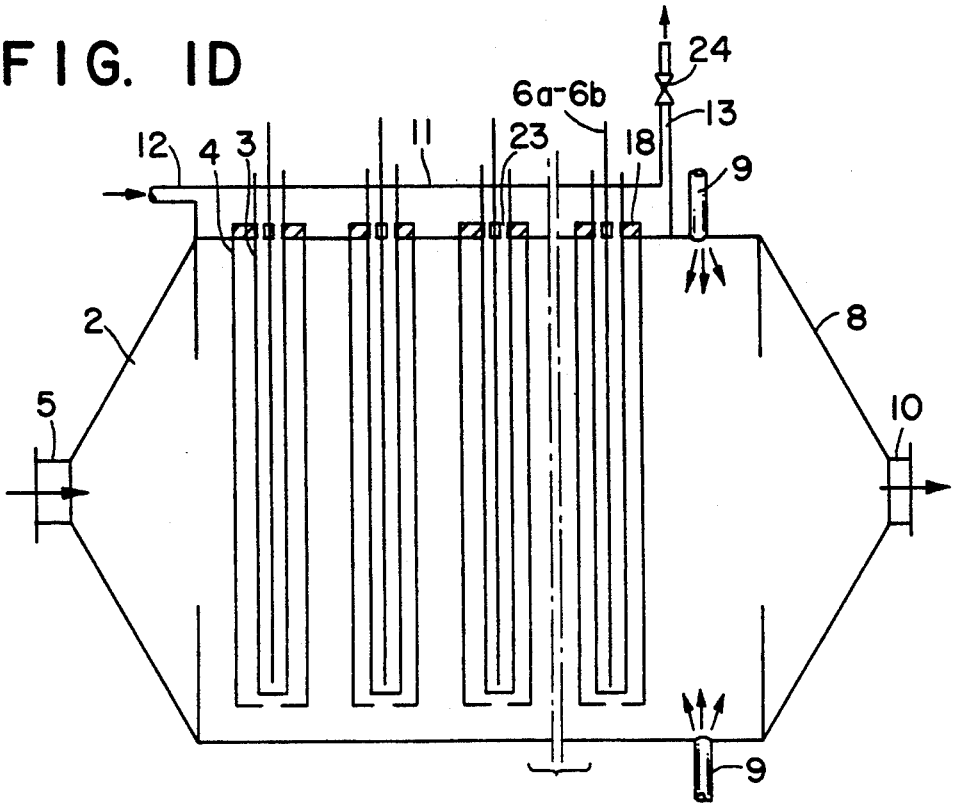
FIGS. 1D and 1E are longitudinal sections through a reactor along the axis of the casings.

FIG. 1D shows, for a horizontal reactor, the same elements as those described in conjunction with FIG. 1A; also shown is a protective casing (11) which comprises an orifice (12) through which the gas G is introduced which contains water vapour, for example, and an orifice (13) which is provided with a valve (24) and which permits regulation of the flow of the gas G. The casing (11) is fixed to the metal armature of the reactor (1) and encloses the assembly of electric resistances and casings enclosing them, with the exception of the end of the electric resistances which permits the supply of electric energy. The pin resistances (3) are placed in the casings (4) by means of discs (18), made of a fibre ceramics material, for example, the resistances comprising passages (23) which enable the gas G, possibly water vapour, to penetrate into the space for the resistances and the casings.

Figure 1E:
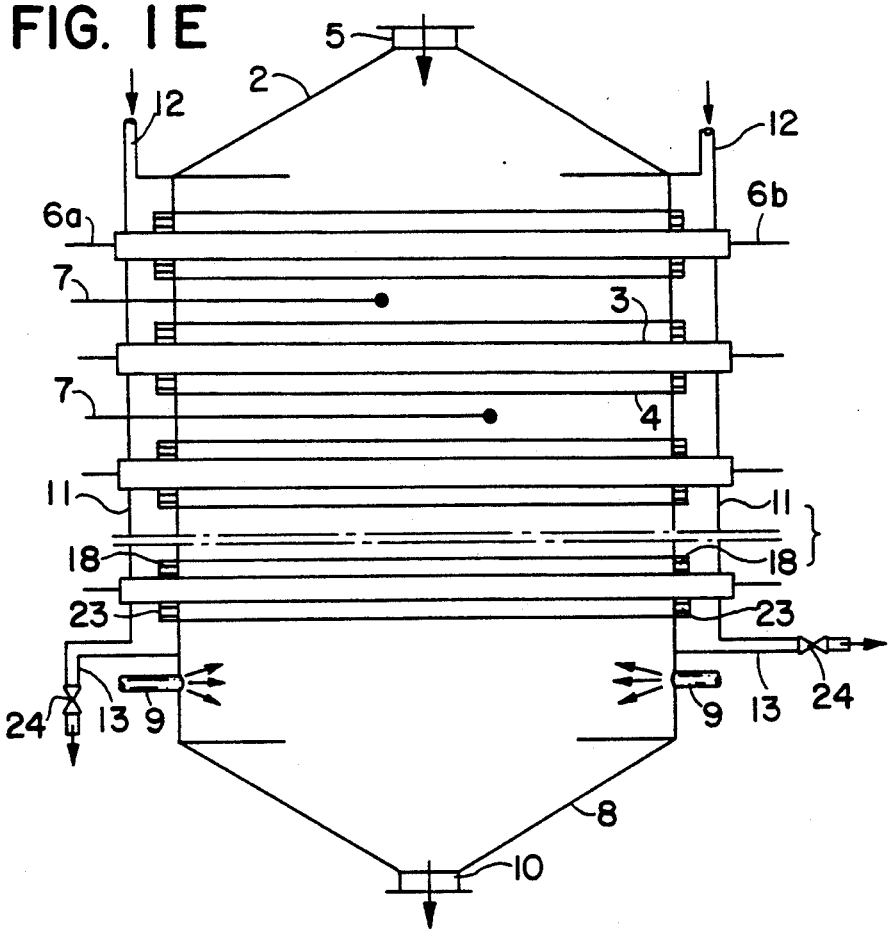

FIG. 1E shows the same elements as those described in conjunction with FIG. 1A; also shown are the protective casings (11) provided with orifices (12) and (13) enabling the circulation inside the casings of the gas G which contains water vapour, for example, and which penetrates into the space for the resistances through the orifices (23) of the discs (18) which position the resistances. The orifices (13) are provided with valves (24) which permit easier regulation of the flow of gas G which may contain water vapour. The casings (11) are fixed to the metal armature of the reactor and enclose the assembly of electric resistances and casings enclosing them, apart from the end of the electric resistances which permit supply of the electric energy. The gas G circulates at a slight overpressure relative to the pressure of the gas process within the reactor, thereby providing a perfectly controlled atmosphere and better diffusion of the gas G towards the process space.

The difference in absolute pressure between the space for the resistances and the process space, or overpressure, is preferably such that the pressure in the space for the resistances is greater by at least 0.1%, and most frequently by at least 1%, than the pressure in the process space. It is not necessary to have a very great overpressure, and most frequently the pressure in the space for the resistances stays at less than twice the pressure in the process space.

FIG. 2 shows a detail of an embodiment of the heating zone according to the invention. The electric heating means used is in the form of cylindrical resistances (3). These resistances have cold zones at either end, and a part of the central zone which is the hot zone accounts for about 68% of the total length, for example.

A reactor of rectangular section is formed, the walls of which are made of insulating refractory concrete (14) and comprise a metal armature (15). A round hole is made in the two side walls, into which a casing (4) is passed, which may be made of ceramics material, and which is twice the diameter of the electric resistance (3). The casing (4) is positioned by means of a stuffing packing system (16) which operates in a groove in the metal armature on a tress of refractory material (17), a tress of ceramics material, for example. The resistance (3) is positioned in the casing (4) by means of discs (18), of a fibre ceramics material, for example, which comprise orifices (23) permitting passage of the gas G which may contain water vapour and which is introduced into the casing (11) through the conduit (12) in the space for the resistances (24).

The heating zone of the resistance (3) is positioned in such a way that it does not penetrate into the orifice which passes through the wall of insulating concrete. Use of a tress (17) at the stuffing press is not imperative since the tress has a positioning role within the scope of the invention, and its main function is not to provide optimum sealing between the inside and outside of the reactor. The stuffing press can also advantageously be replaced by a simpler means permitting positioning of the casings, such as simple discs, for example, made of refractory material.

Thus, a certain number of encased heating resistances are encased in the walls which may be made of a ceramics material and which are arranged in successive horizontal rows, these rows preferably being aligned in such a way that they form a bundle of square or rectangular pitch over the lateral walls of the furnace. A current of gas G which may contain water vapour passes through the casing (11) beyond which only the ends of the resistances and/or their electric supply (6) extends.

EXAMPLE

A horizontal reactor for indirect tempering is used, the length of the pyrolysis zone of which is 2.21 metres and the rectangular section of which is 1.4×3.72 m. The heating means of the reactor are in the form of pin type electric resistances of molybdenum bisilicate ($MoSi_2$); these resistances are enclosed by ceramics casings which are disposed concentrically relative to the centre of the circle enclosing the resistances.

The casings are made of silicon carbide and have an open porosity of 15% by volume. Each casing which is closed at one end encloses 2 pin type resistances (FIGS. 1C and 1D). The casings are disposed perpendicularly to the direction of flow of the charge (vertically) in parallel layers, and form a perpendicularly projecting bundle of square pitch. The length of each pin type branch of the electric resistance is 1.4 m, and the diameter of the resistance is 9 mm. The ceramics casings are 1.4 m in length, have an external diameter of 150 mm and an internal diameter of 130 mm; the spacing Eg (FIG. 1C) between two adjacent casings is 20 mm. The layers of the casings are separated by a wall of refractory concrete with a base of electro-molten alumina. The spacing Ee (FIG. 1c) between the casings and the walls, or size of the passages is 10 mm. The thinnest part of the walls is of a thickness EP (FIG. 1C) of 15 mm.

The first part of the heating zone which is 34 cm in length comprises 20 layers of resistances, each layer comprising 2 casings; in this zone, the charge which is preheated to 600° C., is brought to 900° C. This zone is heat regulated by the intermediary of thermocouplings disposed in the spaces where the charge circulates.

The second part of the heating zone which is adjacent to the first part is 1.87 m in length; it is composed of 20 layers of 11 casings which are disposed in the same way as in the first part of the heating zone. The heating zone is composed of 5 heating sections which are controlled independently and which enable the temperature in that zone to be kept at 900° C., to plus or minus 10° C.

The effluent gases are cooled in a first step to 500° C. by indirect exchange with the gases of the charge; other temperature exchangers then enable their temperature to be reduced to about 350° C.

The charge used is naphtha of density d 20/4=0.715, and the boiling interval of which is between 38° and 185° diluted with water in a weight ratio of water vapour/charge of 0.5:1. The mixture is preheated to 600° C. and cracked at 900° C. in the reactor described hereinabove. The absolute pressure of the gas mixture in the reactor is kept substantially constant and equal to 0.170 MPa. Water which is basically pure is introduced into the space for the resistances in such a way as to obtain and keep an absolute pressure in that space which is substantially constant and equal to 0.175 MPa.

The same charge was cracked in an installation like that described in Example 1 of the patent U.S. Pat. No. 4,780,196 which comprises a silicon carbide multi-channel pyrolysis zone, each channel having a square section of 10 mm at the side and a length of 3 m. The operating conditions are such that the charge is introduced into the reactor at a temperature of 600° C., and the effluents at the end of the pyrolysis operation are 900° C. In this installation, the heating is carried out by a heat-conductive fluid.

With the process according to the invention, after cooling at ambient temperature, a 39.6% weight yield is obtained of ethylene and a 16.4% weight yield of propylene is obtained. When the multi-channel reactor is used which is described in the U.S. Pat. No. 4,780,196, a 38.5% weight yield of ethylene is obtained, and a 15.0% weight yield of propylene.

With the process according to the invention, a maximum initial speed of the coking operation is observed of $10\ g \times h^{-1} \times m^{-2}$. When the silicon carbide multi-channel reactor described in the U.S. Pat. No. 4,780,196 is used, the maximum initial speed of the coking operation observed is $15\ g \times h^{-1} \times m^{-2}$.

The process according to the invention thus makes it possible for the ethylene propylene combination to be obtained with a yield which is better by about 14%, and for the maximum initial speed of the coking operation to be decreased by about 33%.

We claim:

1. A process for the thermal pyrolysis of hydrocarbons in a reaction zone of elongate shape in one direction (one axis), comprising a heating zone and a cooling zone following on from said heating zone, wherein a gaseous mixture containing at least one hydrocarbon with at least two carbon atoms is circulated in the heating zone in a flow direction substantially parallel to the direction (axis) of the reaction zone, said heating zone comprising a plurality of electric heating means arranged in layers substantially parallel to each other and forming a transversely projecting bundle of triangular, square or rectangular pitch, said heating means being grouped in successive transverse sections which are substantially perpendicular to the direction (axis) of the reaction zone, which are independent of each other and which are supplied with electric energy in such a way as to define at least two parts in the heating zone, the first part enabling the charge to be brought to a temperature which is at most equal to about 1300° C., and the second part which follows on from the first part enabling the charge to be kept at a temperature which is substantially equal to the maximum temperature to which it was brought in the first part, and wherein the effluents from the heating zone are cooled, and the products formed at the end of the reaction zone are collected, said process being characterised in that the electric heating means are insulated from direct contact with the gaseous mixture containing at least one hydrocarbon by casings in which casing gas is introduced, the casings being of appropriate permeability and the gas introduced inside said casings at a pressure such that diffusion takes place, at least at certain places, of at least one part of the casing gas from inside the casings to the casing outside thereof, the gas then being able to be diluted in said gaseous mixture.

2. A process according to claim 1, wherein a first part of the heating zone is heated to a maximum temperature which is at most equal to about 1300° C., and wherein the secon part, which follows on from the first part, is heated in such a way that the temperature variation along the entire second part of the heating zone is less than about 50° C., and preferably less than about 20° C.

3. A process according to claim 1, wherein the pressure of the casing gas in the casings is greater by at least 0.1% than the pressure outside said casings.

4. A process according to claim 1, wherein the casings which insulate the electric heating means from direct contact with the gaseous mixture are made of a porous material of sufficient porosity to permit diffusion of at least a part of the gas G through said casings.

5. A process according to claim 4, wherein the casings are made of a porous ceramics material with an open porosity of at least about 1% and at most about 40% by volume.

6. A process according to claim 1, wherein the heating means are insulated from direct contact with the gaseous mixture by cylindrical casings whose diameter is about 1.2 to about 4 times the diameter of the maxium cross section of said heating means.

7. A process according to claim 1, wherein the dimension of the passages in which the gaseous mixture circulates is about 1 to about 100 mm.

8. A process according to claim 1, wherein the reaction zone comprises at least two longitudinal zones, each longitudinal zone comprising at least one layer of heating elements and being separated from the following one by a wall of a refractory material.

9. A process according to claim 1, wherein the electric heating means comprise molybdenum bisilicide resistances.

10. A process according to claim 1, wherein the gaseous mixture also contains water vapour.

11. A process according to claim 1, wherein the gaseous mixture contains ethane and hydrogen.

12. Process according to claim 1, wherein the gaseous mixture contains a C4 cut.

13. A process according to claim 1, wherein the maximum temperature is 800°–1100° C.

14. A process according to claim 12, wherein the gaseous mixture also contains hydrogen.

* * * * *